US006200743B1

(12) United States Patent
Elst et al.

(10) Patent No.: US 6,200,743 B1
(45) Date of Patent: Mar. 13, 2001

(54) RADIATION-SENSITIVE EMULSION, LIGHT-SENSITIVE SILVER HALIDE PHOTOGRAPHIC FILM MATERIAL AND RADIOGRAPHIC INTENSIFYING SCREEN-FILM COMBINATION

(75) Inventors: Kathy Elst, Kessel; Ann Verbeeck, Begijnendijk; Paul Callant, Edegem, all of (BE)

(73) Assignee: AGFA-Gevaert, N.V., Mortsel (BE)

( * ) Notice: Subject to any disclaimer, the term of this patent is extended or adjusted under 35 U.S.C. 154(b) by 0 days.

(21) Appl. No.: 09/533,378

(22) Filed: Mar. 22, 2000

Related U.S. Application Data

(60) Provisional application No. 60/131,677, filed on Apr. 29, 1999.

(30) Foreign Application Priority Data

Apr. 16, 1999 (EP) ..... 99201190

(51) Int. Cl.[7] ..... G03C 1/16
(52) U.S. Cl. ..... 430/576; 430/581
(58) Field of Search ..... 430/576, 581

(56) References Cited

U.S. PATENT DOCUMENTS

| | | | | |
|---|---|---|---|---|
| 2,080,050 | | 5/1937 | Kendall | 430/591 |
| 3,850,645 | | 11/1974 | Herz et al. | 430/462 |
| 4,876,183 | * | 10/1989 | Miyasaka et al. | 430/567 |
| 5,008,181 | * | 4/1991 | Ikegawa et al. | 430/572 |
| 5,290,655 | * | 3/1994 | Iwasaki | 430/139 |

FOREIGN PATENT DOCUMENTS

| | | |
|---|---|---|
| 0 758 760 | 2/1997 | (EP) . |
| 0 890 873 | 1/1999 | (EP) . |

* cited by examiner

*Primary Examiner*—Hoa Van Le
(74) *Attorney, Agent, or Firm*—Breiner & Breiner

(57) ABSTRACT

A spectrally-sensitized emulsion has been described, wherein said emulsion comprises {111} tabular silver halide grains having an average aspect ratio of at least 2 with two flat parallel {111} crystal faces accounting for a total projective surface of said parallel crystal faces in said emulsion of at least 50%, characterized in that a site-directing compound is present at said faces, satisfying the general formula I as described herein is present.

A light-sensitive silver halide photographic film material comprising a support and on one or both sides thereof at least one light-sensitive emulsion layer having an emulsion as disclosed has also been described as well as a radiographic screen/film combination comprising such a light-sensitive silver halide photographic film material and a supporting or self-supporting X-ray intensifying screen, characterized in that said supported or self-supporting X-ray intensifying screen essentially consists of luminescent phosphor particles emitting green light.

10 Claims, No Drawings

RADIATION-SENSITIVE EMULSION, LIGHT-SENSITIVE SILVER HALIDE PHOTOGRAPHIC FILM MATERIAL AND RADIOGRAPHIC INTENSIFYING SCREEN-FILM COMBINATION

This application claims the benefit of U.S. Provisional aplication 60/131,677, filed Apr. 29, 1999.

FIELD OF THE INVENTION

The present invention relates to a light-sensitive silver halide photographic emulsion, a material comprising said emulsion and a screen-film combination of a radiographic intensifying phosphor screen and said material.

BACKGROUND OF THE INVENTION

Tabular silver halide grains are grains possessing two parallel crystal faces with an aspect ratio of two or more. Said aspect ratio is defined as the ratio between the diameter of a circle having an equivalent surface area as one of these crystal faces, and the thickness, being the distance between the two major faces.

Tabular grains are known in the photographic art for quite some time. As early as 1961 Berry et al. described the preparation and growth of tabular silver bromoiodide grains in Photographic Science and Engineering, Vol 5, No 6. A discussion of tabular grains appeared in Duffin, Photographic Emulsion Chemistry, Focal Press, 1966,p.66–72.

Early patent literature includes Bogg U.S. Pat. No. 4,063,951, Lewis U.S. Pat. No. 4,067,739 and Maternaghan U.S. Pat. Nos. 4,150,994; 4,184,877 and 4,184,878. However the tabular grains described herein cannot be regarded as showing a high diameter to thickness ratio, commonly termed aspect ratio. In a number of U.S. patents filed in 1981 and issued in 1984 tabular grains with high aspect ratio and their advantages in photographic applications are described as e.g. U.S. Pat. Nos. 4,434,226; 4,439,520; 4,425,425 and 4,425,426 and in Research Disclosure, Volume 225, January 1983, Item 22534.

Anisotropic growth characteristics for the said tabular grains are known to be due to the formation of parallel twin planes in the nucleation step of the precipitation. However for the said {111} tabular silver halide grains rich in silver chloride use of a crystal habit modifier in relatively high amounts is therefore required, as has been illustrated in U.S. Pat. Nos. 4,713,323; 4,804,621; 5,176,692; 5,183,732; 5,185,239; 5,252,452; 5,286,621; 5,298,385 and 5,298,388. Treatment with iodide of tabular grain emulsions having {111} crystals rich in silver chloride in order to get an enhanced morphological stability and enhanced photographic performance has been disclosed in EP-A 0 678 772 and in Research Disclosure 388046, published Aug. 1, 1996.

However as a global result fairly heterogeneous emulsion crystal distributions are obtained: a common variability coefficient (defined as a ratio between average standard deviation on equivalent circular diameter and the said average equivalent circular diameter) of 0.30 to 0.60 is calculated, partly due to the presence of quite a large number of non-tabular grains having a sphere equivalent diameter of less than 0.3 $\mu$m. Moreover differences in thickness growth are observed, said differences leading to unevenness as a consequence of observed differences in image tone.

Heterodispersity of grain morphology further leads to e.g. uncontrolled chemical and spectral sensitization, lower contrast and lower covering power, thereby losing typical advantages of the said grains as referred to hereinbefore.

Until now efforts in order to get more monodisperse tabular silver halide crystal distributions in emulsion preparation have been directed towards silver halide crystals rich in silver bromide as has e.g. been described in U.S. Pat. Nos. 4,797,354; 5,147,771; 5,147,772; 5,147,773; 5,171,659; 5,248,587; 5,204,235; 5,210,013; 5,215,879; 5,250,403; 5,252,442, 5,252,453; 5,254,453; 5,318,888; 5,439,787; 5,472,837; 5,482,826 and 5,484,697 and in Research Disclosure No. 391, p. 713–723 (1996).

Many attempts have been made in order to improve the degree of homogeneity of the size and shape of the crystals but the majority of them is related with tabular grains rich in silver bromide. So radiographic materials comprising emulsions having monodisperse tabular silver brom(oiod)ide crystals have e.g. been described in U.S. Pat. Nos. 5,252,442 and 5,508,158. The same preparation methods as for the forementioned tabular grains rich in silver bromide can however not be applied as such in preparing tabular grains rich in silver chloride, especially due to the presence of crystal habit modifiers or stabilizers, usually adenine or more generally aminoazaindenes, as this leads to the disadvantages set forth hereinbefore. Stabilization of the crystal habit of anisotropically grown crystals having flat parallel twins however remains an ever lasting demand.

Combinations of intensifying screens provided with luminescent phosphors and light-sensitive silver halide photographic materials are conventionally used for medical diagnosis. By X-ray radiation the luminescent phosphors in the screen panel or panels are converting X-rays into visible radiation, thereby exposing the film material in contact with the said panel (for single-side coated materials as e.g. in mammography) or panels (for duplitized materials as e.g. in chest imaging).

In mammography e.g. the compressed breast is irradiated with soft X-rays emitted from an X-ray generating device and the modulated X-rays are detected with a radiographic X-ray conversion screen, also called intensifying screen, fluorescent screen or phosphor screen. The X-ray conversion screen comprises a luminescent phosphor which converts the absorbed X-rays into visible light and the emitted visible light exposes a silver halide film that is brought into contact with said X-ray conversion screen. After film processing, comprising the steps of developing, fixing, rinsing and drying, a mammogram is obtained which can be read on a light box. No other field of medical radiology demands such a high level of image quality as mammography and the ability of the mammogram to portray relevant diagnostic information is highly determined by the image quality of the screen-film system. Image quality is manifested by a number of features in the image including sharpness, noise, contrast, silver image colour and skin line perceptibility. Conventional mammography films can roughly be classified in low and high contrast types according to the value of their average gradation as defined above. The low contrast type can be characterized by a relatively low average gradation ranging from 2.0 to 2.5 whereas the average gradation of the high contrast type may range higher than 3.0. Often, high contrast films are preferred because of the higher ability to detect tiny cancers deep in the glandular tissue of the breast. If the contrast is too high, however, it may preclude visualization of both thin (i.e. the skin line) and thick tissues (i.e. the inside of the breast) in the same image due to lack of exposure latitude. Therefore, some radiologists prefer low contrast mammography films. When the contrast is low, skin line perceptibility is excellent, but then the chance of missing possibly malignant breast lesions is high. Thus a balance has to be found between contrast and exposure latitude and an example of this approach has been described in U.S. Pat. No. 5,290,655.

Maintaining the image quality constant is becoming another requirement of facilities performing mammography. Accordingly, quality control tests are executed on a regular basis in order to monitor the consistency of the performance of the X-ray equipment, the image receptors and the film processor. In order to minimize the influence of varying film processing time, temperature, chemistry and replenishment, a preferred mammography film requires a stable speed and contrast with regard to these processing parameters. As in addition, there is a general trend in the field of radiology to shorten the film processing time and likewise in the field of mammography, being driven by intensified screening programs, the interest has focused on rapid access of mammograms. As a consequence, mammography films are preferred which comprise silver halide crystals that can be processed rapidly and consistently in a dry-to-dry processing cycle of 90 seconds or less and therefore, most mammography films today comprise good developable cubic silver halide crystals. As described in EP-A 0 712 036 such cubic crystals show a stable speed and contrast upon varying processing parameters, but said cubic grain emulsions however are characterized by a very high contrast, resulting in a poor skin line perceptibility.

Especially in rapid processing applications it is very difficult to obtain the desired low fog, high speed and high covering power simultaneously. Replacing cubic grain emulsions by tabular grain emulsions is in favour of getting a high covering power at moderate coating amounts of silver halide as has been demonstrated e.g. in U.S. Pat. No. 4,414,304. Disadvantages of tabular grains however are the lower contrast than the contrast obtainable with cubic grains, the brown colour hue of developed crystals and the residual colouration of the processed image, especially in short processing cycles, due to strong adsorption of huge amounts of spectral sensitizing dye(s) at the large specific surface area, characteristic for the said tabular grains.

Making use of a mixture of cubic and tabular grains or of a multilayer arrangement of cubic and/or tabular grains in order to provide a good image tone as in EP-A 0 874 275 and in EP-A 0 770 909 respectively is more complex and less interesting from the point of view of reproducibility of the production process. Another method provided in order to get a suitable image tone has been described in EP-A 0 844 520, wherein the light-sensitive silver halide emulsion layer comprises blue coloured polymeric matting particles.

The above cited references on tabular grains are mainly concerned with high sensitive silver bromide or silver bromoiodide emulsions. Tabular grain emulsions having a high aspect ratio are known to provide several advantages over more conventional spherical grains as e.g. a high covering power, a high (spectral) sensitivity and a lower coating weight, which saves costs in manufacturing.

Said lower coating weight is especially preferred if rapid processing applications, preferably accompanied by low replenishing amounts of developer and fixer, are required, which is nowadays an ever more returning demand. In order to prevent residual colour or dye stain after said rapid processing in low replenishing conditions it is most favourable if even no antihalation dyes are used as those dyes are normally coated in the layer, most close to the support, so that it takes time to leave the film. In mammography however literature is scarce with respect to the use of antihalation dyes and dye stain mostly results from the presence after processing of residual amounts from the normally used high amounts of spectral sensitizing dyes, especially in the presence of tabular grain emulsions having a large surface to volume ratio. Said spectrally sensitizing dyes are well known in the art of photography, especially for green and red sensitization of flat tabular grains, whereas for blue and/or ultraviolet sensitization the number of examples is rather limited. Further it is known to use in mammography combinations of green-emitting phosphor screens with film materials containing green sensitized tabular grain emulsions. After processing of exposed emulsion grains residual amounts of dyes may be present, especially due to the presence of huge amounts of spectral sensitizing dyes as tabular grains have a large specific surface capable of adsorbing said huge amounts. Those huge amounts are further in favour of high speed and image quality (especially sharpness), required in diagnostic imaging where it is further of utmost importance to reduce irradiation of the patient to minimum levels.

Although not restricted to single-side coated materials and although not restricted further to materials having green spectral sensitizers, the present invention is especially useful in mammographic applications, wherein, for reasons of good image definition light-sensitive layers are present on only one side of the film support. Image formation therein proceeds with a system consisting of only one intensifying screen, wherein a high speed, a high contrast (preferably a high "toe contrast") and low residual dye stain are desired. Specific measures taken therefor have e.g. been described in U.S. Pat. No. 5,290,655; in EP-A's 0 264 788 and 0 577 027 and in Research Disclosure No. 33487 (1992), p. 161 but it is clear that any measure in order to decrease residual dye stain level, just as for duplitized or double side coated radiographic materials, without further losses with respect to sensitometry and image quality is highly desired. The said losses may become particularly prohibitive the thinner the flat tabular grains are: an enhanced specific surface resulting therefrom requires higher amounts of spectrally and chemically sensitizing agents which may cause adverse effects as there are desensitization and a decreasing decoloration ability.

OBJECTS OF THE INVENTION

Therefore it is an object of the present invention to provide a light-sensitive spectrally sensitized {111} tabular silver halide emulsion having crystals or grains the habit of which is stabilized during growth in order to provide "chemical homogeneity" besides "physical homogeneity" within its grain distribution in favour of sensitometry (fog, speed,gradation) and decolorization properties.

It is a further object of the present invention to provide a light-sensitive silver halide photographic material comprising a support and on one or both sides thereof at least one light-sensitive hydrophilic layer comprising such grains in order to be applicable in combination with luminescent intensifying screens and more particularly to provide a screen-film image-forming combination or system wherein a light-sensitive silver halide photographic material as set forth before is combined with an intensifying screen in order to obtain an image suitable for medical diagnosis, having a very high image quality, i.e., low fog level, high overall-contrast with an enhanced sharpness (low cross-over) after rapid processing of the said material, and, more particularly, wherein little or no residual colour or dye stain is observed in the processed material.

SUMMARY OF THE INVENTION

In order to reach the objects of the present invention a spectrally sensitized emulsion has been disclosed wherein said emulsion comprises {111} tabular silver halide grains having an average aspect ratio of at least 2 with two flat parallel {111} crystal faces accounting for a total projective surface of said parallel crystal faces in said emulsion of at least 50%, characterized in that a site-directing compound is present at said faces, said formula satisfying general formula I as described hereinafter.

A light-sensitive silver halide photographic film material comprising a support and on one or both sides thereof at least one light-sensitive emulsion layer having an emulsion as disclosed has also been claimed as well as a radiographic screen/film combination comprising such a light-sensitive silver halide photographic film material and a supporting or self-supporting X-ray intensifying screen, characterized in that said supported or self-supporting X-ray intensifying screen essentially consists of luminescent phosphor particles emitting green light, more particularly light in the wavelength range between 540 and 555 nm for which the said emulsion having {111} tabular crystal faces has been made sensitive by the presence of a J-aggregating dye. Said screen/film combination is further particularly suitable for use in mammographic applications as well as for radiographic chest imaging.

DETAILED DESCRIPTION OF THE INVENTION

From our experiments it has now unexpectedly been observed that the presence of one or more azacyanine dye is favorable as a compound present in the preparation of, preferably green-sensitized, tabular grain emulsions rich in silver bromide, coated in at least one light-sensitive emulsion layer of a silver halide photographic material, wherein said layer or layers has(have) been coated on one or both sides of a support. More preferably said material is suitable for use in a screen/film system of the present invention as claimed hereinafter and makes the objects of the present invention to become effectively realized, wherein the said azacyanine dyes are added to the tabular grain emulsions before addition of other dyes or stabilizers and more preferably before starting chemical sensitization.

The synthesis of aza- or diazacyanine dyes suitable for use as dyes for silver halide emulsions according to the present invention has been described in U.S. Pat. No. 2,307,049. Azamethine dyes made with arylene diamine can be found in U.S. Pat. No. 2,368,305 and are suitable for use in the preparation of {111} tabular emulsions of the present invention as well. Other suitable aza-pseudocyanines originally suitable for use as optical brighteners have been disclosed in U.S. Pat. No. 3,130,197, as well as acid substituted azaquino-pseudo-cyanines or cyazines, disclosed in U.S. Pat. No. 3,697,282 for use as spectral sensitizers in colour materials. Symmetrical and unsymmetrical quinoline azacyanine dyes can further be used as those disclosed in BE 812431 and in CS 1976695 respectively, or the more recently disclosed pseudo-cyanine or azamethine dyes in U.S. Pat. No. 4,977,076.

Azacyanines cited in the foregoing references are all suitable for use in the preparation of {111} tabular emulsions used in the material and the film/screen system according to the present invention. Specific azacyanine dyes particularly suitable for use in the emulsions, materials and in the film-screen system according to the present invention are following:

(I.1)

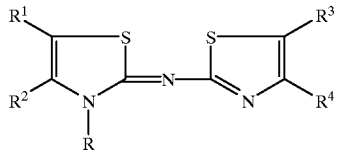

(I.2)

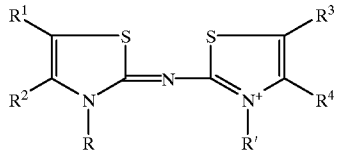

wherein each of the substituents $R^1$–$R^4$ independently represents hydrogen, an (unsubstituted or substituted) alkyl, an (unsubstituted or substituted) aryl or an (unsubstituted or substituted) aralkyl;

wherein $R^1$ and $R^2$ and/or $R^3$ and $R^4$ may form a (substituted or unsubstituted) benzoring, which, if substituted, has the same or different substituents as $R^1$–$R^4$;

wherein R represents an (unsubstituted or substituted) alkyl, an (unsubstituted or substituted) aryl or an (unsubstituted or substituted) aralkyl group;

wherein R' represents hydrogen, an (unsubstituted or substituted) alkyl, an (unsubstituted or substituted) aryl or an (unsubstituted or substituted) aralkyl group; and wherein cations or anions are present as charge compensating ions.

More particularly each of R and R' independently represents $(CH_2)_nH$ or $(CH_2)_nOH$, n being an integer having a value from 1 to 4, $(CH_2)_m(SO_3^-)$ or $(CH_2)_mO(SO_3^-)$, m being an integer having a value from 2 to 4, $(CH_2)_2CH(Y)SO_3^-$ wherein Y represents $CH_3$—, —Cl or —OH;

$(CH_2)_mN(R)SO_3^-$ or $(CH_2)_mN(R')SO_3^-(CH_2)_n(COO^-)$ or $(CH_2)_n(COOH)$, $(CH_2)_sSO_2^-(CH_2)_tH$ wherein s equals 2 or 3 and t equals 1 or 2;

$(CH_2)_x$-Phen-W, wherein W represents —$COO^-$ or $SO_3^-$; Phen represents phenyl which is substituted or unsubstituted; and x equals 1, 2, 3 or 4, $(CH_2)_nCONHSO_2R$ or $(CH_2)_nCONHSO_2R'$, provided that R' may represent hydrogen as set forth hereinbefore or a latent solubilizing group as, e.g., $(CH_2)_m$—(C═O)—O—$CH_2$—(C═O)—$CH_3$, wherein m' is an integer having a value of from 1 to 5.

In order to get neutral azacyanine structures preferred charge compensating cations are $Li^+$, $Na^+$, $K^+$, $HN^+Et_3$, wherein Et represents ethyl, whereas preferred charge compensating anions are $Cl^-$, $Br^-$, $I^-$, $^-OTos$, $^-OMes$, $CF_3SO_3^-$, wherein $^-OTos$ represents tosylate and $^-OMes$ represents mesylate.

Specific examples of azacyanine dyes are given in the formulae (I.3) to (I.13) hereinafter:

(I.3)

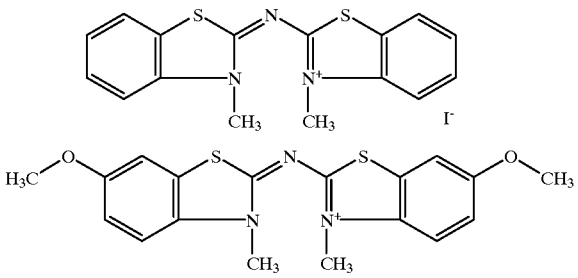

(I.4)

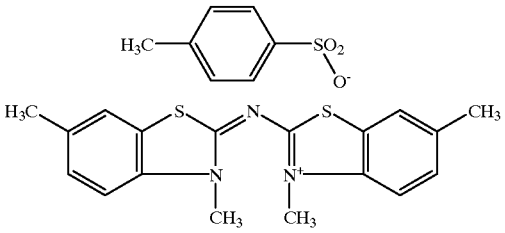

(I.5)

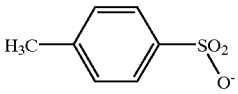

(I.6)

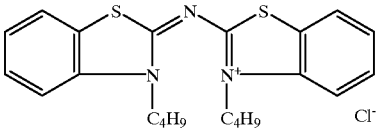

(I.7)

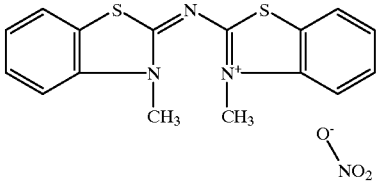

(I.8)

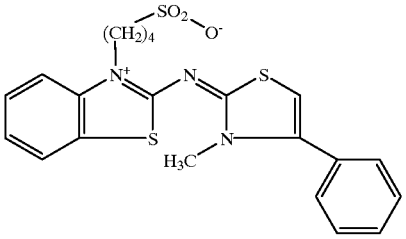

(I.9)

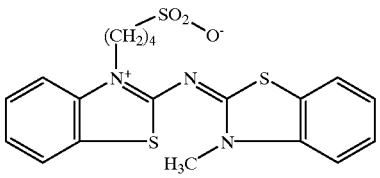

(I.10)

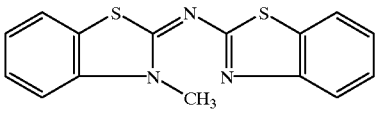

-continued (I.11)

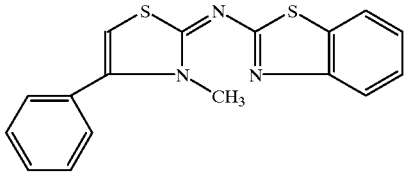

(I.12)

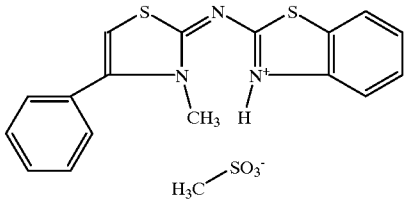

(I.13)

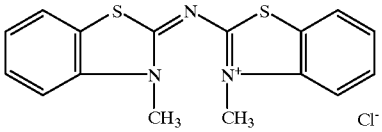

In praxis when used in a film/screen system according to the present invention the light emitted imagewise by said X-ray intensifying screen irradiates a contacting photographic silver halide emulsion layer film which after exposure is developed to form therein a silver image in conformity with the X-ray image.

For use in common medical radiography (projection radiography) the X-ray film for use e.g. in mammographic diagnosis comprises a transparent film support, coated on only one side with a silver halide emulsion layer. During the X-ray irradiation said film (made sensitive to green light by spectral sensitization of its light-sensitive emulsion grains) is arranged in a cassette with one X-ray intensifying screen (emitting green light by suitable luminescent phosphors) making contact with the silver halide emulsion layer.

Luminescent phosphors suitable for use in the conventional radiographic system must have a high prompt emission of fluorescent light on X-ray irradiation and low afterglow in favour of image sharpness. The relationship between resolution and speed of X-ray intensifying screens has been described e.g. in Med. Phys. 5(3), 205 (1978).

Specific intensifying screens emitting green for use in the diagnostic image forming method according to the present invention are the commercially available X-ray generating devices providing an exposure to soft X-rays with a tube voltage of 20 to 40 kV.

A preferred luminescent phosphor coated in the X-ray conversion screen used in the film/screen system according to the present invention is $Gd_2O_2S$:Tb, which emits green light in the wavelength range from 540 to 555 nm as required for mammographic applications. Said phosphor and its use in intensifying screens have been described extensively in patent literature, e.g. in U.S. Pat. Nos. 3,872,309; 4,130,429; 4,912,333; 4,925,594; 4,994,355; 5,021,327; 5,107,125 and 5,259,016 and in GB-Patent 1,489,398 and is suitable for use in the context of the film/screen system according to the present invention. The thickness of the phosphor layer therein depends on the amount of coated phosphor required in order to obtain the desired screen speed. X-ray intensifying screens according to the present invention can be self-supporting or supported. X-ray intensifying screens in accordance with the present invention generally comprise in order: a support (also called substrate), at least one layer comprising phosphor particles dispersed in a suitable binder and a protective coating coated over the phosphor containing layer to protect said layer during use. Further, a primer layer is sometimes provided between the phosphor containing layer and the substrate to closely bond said layer thereto.

In order to obtain a satisfactory image resolution, mammography films comprise one or more light-sensitive silver halide emulsion layer(s) on only one side of a transparent support, which is typically a blue coloured polyethylene-terephtalate film having a thickness of 175 μm. Preferably one or more backing layer(s), which operate as anti-halation and anti-curl layer, are present on the opposite side of said support. One or more subbing layers may be coated directly on the support to improve the adhesion of the emulsion and backing layer(s) to the support. In addition, an undercoat layer between the emulsion and subbing layer(s) and a protective layer on top of the emulsion layer(s) may be present. Additional non light-sensitive intermediate layers are optional.

For double-side coated or duplitized materials it is recommended to make use of hydrophilic antihalation layers in contact with hydrophobic subbing layers in order to reduce cross-over to a minimum as has been disclosed e.g. in EP-A's 0 678 772, 0 712 034, 0 752 617, 0 790 526 and 0 844 520. Useful antihalation dyes therefore have been given e.g. in EP-A's 0 489 973, 0 587 229, 0 587 230, 0 586 748, 0 656 401, 0 724 191, 0 781 816 and 0 786 497. It is clear that both series of references are not limitative. Specific intensifying screens emitting green for use in the diagnostic image forming method according to the present invention are the commercially available X-ray generating devices providing an exposure to X-rays with a tube voltage of about 70 kV as applied for chest imaging.

In a preferred embodiment, the light-sensitive emulsion layer(s) of the material according to the present invention comprise(s) tabular silver halide grains as will be illustrated in detail by the working examples. More preferably said tabular grains are {111} tabular silver bromo(iodide) grains as those described in U.S. Pat. No. 5,595,864. According to the present invention the emulsion preferably comprises {111} tabular silver bromide or silver bromoiodide grains or crystals, optionally having from 0 to 10 mole % of chloride ions, have two parallel (hexagonal) (111) faces with a ratio of the diameter of a circle having the same area as these faces versus the thickness, being the distance between the two major faces, equal to or more than 2; an average equivalent crystal diameter of at least 0.3 μm, and more preferably of at least 0.5 μm up to 3.0 μm; an average thickness of from 0.06 to 0.30 μm and said grains account for a total projected area of at least 50%, preferably at least 70% and even more preferably more than 90% with respect to all grains present. The precipitation methods of tabular silver halide grains are also extensively described in patent literature. Preferred methods, providing relatively narrow grain size distributions with a variation coefficient of less than 0.30 that can be applied have e.g. been described in U.S. Pat. Nos. 5,290,655 and 5,693,459 and in EP-A's 0 518 066 and 0 577 886.

According to the present invention said silver halide emulsions have tabular grains with a hexagonal {111} tabular crystal habit show a procentual variation coefficient on average crystal diameter of the silver halide distribution of less than 20%.

Though the silver halide emulsions of the present invention may comprise grains having chloride in combination with bromide or bromoiodide, the preferred tabular grain emulsions according to the present invention comprise silver bromide or silver iodobromide grains having bromide in an amount of at least 90 mole %, having an average iodide content of at most 3 mole % and more preferably iodide in an amount of at most 1 mole %. The iodide distribution can be homogeneous over the whole crystal volume or may be present as a so-called core-shell crystal structure, i.e. a silver halide crystal having distinct phases characterized by a different iodide to bromide ratio. More than one shell can be present and between different phases it can be recommended to have a phase enriched in silver iodide by applying the so-called conversion technique during precipitation. Iodide ions can be provided by adding aqueous solutions of inorganic salts thereof as e.g. sodium, potassium or ammonium iodide or by adding organic compounds which are capable of releasing iodide ions as described in the EP-A's 0 561 415; 0 563 701; 0 563 708; 0 649 052 and 0 651 284.

As has been set forth by Tani in Kogyo Kagaku Zasshi (1968), 71(4), 604–605 azacyanines do not work as spectral sensitizers on grains rich in silver bromide. Opposite thereto azacyanines may be successfully applied as blue/ultraviolet sensitizers for {111} tabular grains rich in silver chloride as has extensively been described in EP-A 0 890 873. As said azacyanines should be considered as non-J-aggregating dyes, the emulsions according to the present invention correspond to a specific embodiment of the emulsions as claimed in EP-A 0 953 867.

In a preferred embodiment of the present invention a light-sensitive silver halide emulsion has been disclosed, said emulsion comprising tabular grains having an aspect ratio of at least 2:1 (more preferably between from 5:1 to 50:1 and still more preferably from 8:1 to 20:1, an average crystal diameter between 0.3 μm and 3.0 μm (more preferably between 0.5 μm and 3.0 μm) and an average thickness of less than 0.50 μm (more preferably between 0.06 and 0.25 μm) accounting for at least 50% (more preferably more than 70% and even more preferably more than 90%) of the total projective surface area of said grains, further having at least one J-band aggregating dye and at least one non-J-band aggregating dye.

According to the present invention {111} tabular grain emulsions have gelatin or colloidal silica sol as a binder. In one embodiment the precipitation of the tabular silver halide crystals according to the present invention is indeed performed in the presence of a protective, hydrophilic colloid, e.g. conventional lime-treated or acid treated gelatin but also oxidized gelatin or a synthetic peptiser may be used. The preparation of such modified gelatin types has been described in e.g. "The Science and Technology of Gelatin", edited by A. G. Ward and A. Courts, Academic Press 1977, page 295 and next pages. The gelatin can also be an enzyme-treated gelatin as described in Bull. Soc. Sci. Phot. Japan, No. 16, page 30 (1966). Before and during the formation of the silver halide grains it is common practice to establish a gelatin concentration of from about 0.05% to 5.0% by weight in the dispersion medium.

In another embodiment tabular silver halide grains used in emulsions according to the present invention are precipitated in the absence of gelatin by using colloidal silica sol as a protective colloid in the presence of an onium compound, preferably a phosphonium compound, as has been described in EP-A 0 677 773.

In order to control the grain size, beside azacyanine dyes, grain growth restrainers or accelerators may be used during the precipitation or the flow rate or concentration of the silver and halide salt solutions, the temperature, pAg, physical ripening time, etc. may be varied. Silver halide solvents such as ammonia, a thioether compound, thiazolidine-2-thione, tetra-substituted thiourea, potassium or ammonium rhodanide and an amine compound may be present during grain precipitation in order to further adjust the average grain size.

At the end of the precipitation the emulsion is made free from excess of soluble inorganic salts by a conventional washing technique e.g. flocculation by ammonium sulphate or polystyrene sulphonate, followed by one or more washing and redispersion steps.

Another well-known washing technique is ultrafiltration. Finally, extra gelatin can be added to the emulsion in order to obtain a gelatin to silver ratio which is optimized with respect to the coating conditions and/or to establish the required thickness of the coated emulsion layer. Preferably a gelatin to silver halide weight ratio ranging from 0.3 to 1.0 is then obtained.

The silver halide emulsions may be chemically sensitized according to the procedures described in e.g. "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in the above mentioned literature, chemical sensitization can be carried out by effecting the ripening in the presence of small amounts of compounds containing sulphur, selenium or tellurium e.g. thiosulphate, thiocyanate, thiourea, selenosulphate, selenocyanate, selenoureas, tellurosulphate, tellurocyanate, sulphites, mercapto compounds, and rhodamines. In a preferred embodiment, these compounds are applied in combination with a noble metal salt, preferably a gold complex salt, but also salts of platinum, palladium and iridium as described in U.S. Pat. No. 2,448,060 and GB-Patent No. 618,061 may be used. The amount of gold, used in the chemical ripening of emulsions according to the present invention, is preferably in the range of 25 to 45 ppm vs. the amount of metallic silver. Additions of sulphur and/or selenium and/or tellurium and gold may be carried out consecutively or simultaneously. In the latter case the addition of goldthiosulphate, goldselenosulphate or goldtellurosulphate compounds may be recommended. Optionally, small amounts of compounds of Rh, Ru, Pd, Pb, Cd, Hg, or Tl can be added.

Other preferred selenium containing compounds for use in the chemical ripening of emulsions of the present invention have been described in EP-A's 0 862 088, 0 889 354 and 0 895 121.

Also reductors may be added as chemical sensitizers e.g. tin compounds as described in GB-Patent No. 789,823, amines, hydrazine derivatives, formamidine-sulphinic acids, and silane compounds.

The chemical sensitization can also proceed in the presence of phenidone and/or its derivatives, a dihydroxybenzene as hydroquinone, resorcinol, catechol and/or a derivative(s) thereof, one or more stabilizer(s) or antifoggant (s), one or more spectral sensitizer(s) or combinations of said ingredients. In a preferred embodiment in order to prepare radiation-sensitive emulsions according to the present invention azacyanines according to the general formula (I) are added before addition of other addenda such as the chemical ripening agents and/or spectral sensitizers mentioned hereinbefore. Preferably the time between adding said azacyanine dyes and said ripening agents and/or spectral sensitizers is long enough in order to provide the azacyanine dyes perform their (habit) stabilizing action on the grown emulsion crystals.

A suitable way to stabilize emulsions having been chemically ripened with sensitizers comprising selenium has been described in U.S. Pat. No. 5,654,134 wherein benzothiazolium compounds, mercapto containing agents and disulfides have been described in order to provide a good fog-sensitivity relationship.

The silver halide emulsion grains present in a radiographic film as in the present application are spectrally sensitized in order to optimally detect the light emitted from the X-ray conversion screen. So in case of a preferred mammography film its spectral sensitivity is ranging from 5 to 80 microjoules per $m^2$ measured at the emission maximum of the X-ray conversion screen, said spectral sensitivity being defined herein as the amount of exposure to light of a given wavelength required to obtain an optical density Dmin+1.0 after processing.

The silver halide emulsion can be spectrally sensitized by adding one or several cyanine dyes, merocyanine dyes, complex cyanine dyes, complex merocyanine dyes, hemicyanine dyes, styryl dyes and hemioxonol dyes. In a preferred embodiment according to the present invention the radiation-sensitive emulsion has silver halide grains sensitive to irradiation in the wavelength range between 540 and 555 nm by the presence of a J-aggregating spectrally sensitizing cyanine dye. Preferred (orthochromatic) spectral sensitizers or dyes are J-aggregating dyes corresponding to the general formula (II)

(II)

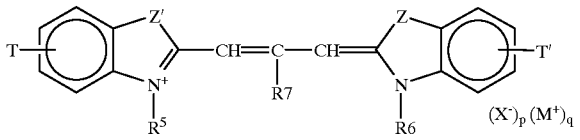

wherein

Z and Z' each independently represents a nitrogen or an oxygen atom and wherein Z is substituted with $R^8$ if Z is a nitrogen atom and Z' is substituted with $R^9$ if Z' is a nitrogen atom;

$R^5$, $R^6$ and $R^8$ and $R^9$ each independently represents substituted or unsubstituted alkyl, $R^7$ represents hydrogen, substituted or unsubstituted alkyl or substituted or unsubstituted aryl, T and T' may each independently represent hydrogen, a substituted or unsubstituted alkyl, a substituted or unsubstituted aryl or a substituted or unsubstituted heterocyclic group;

$(X^-)_p$ represents an negatively charged atom or group of atoms to compensate for the positive charge(s) present on the dye, and $(M^+)_q$ represents a positively charged atom or group of atoms to compensate for the negative charge(s) present on the dye, wherein p and q each represent an integer in order to get an electronically neutral compound.

In a more preferred embodiment in the emulsion according to the present invention the J-aggregating cyanine dye corresponds to the general formula (II) wherein $R^7$ is $—C_2H_5$, Z and Z' are both representing an oxygen atom, at least one of $R^5$ and $R^6$ represents a sulphoalkyl group, preferably corresponding to the formulae —$(CH_2)_nSO_3^-$ wherein n equals 2, 3 or 4,

—$(CH_2)_2$—$CH(CH_3)$—$SO_3^-$

—$CH_2$—CHY'—$CH_2$—$SO_3^-$ wherein Y' represents —OH or —Cl;

a sulphatoalkyl group, preferably corresponding to the formula

—$(CH_2)_nOSO_3^-$ wherein n equals 2, 3 or 4, an acylsulphonamido group, preferably corresponding to the formulae —$(CH_2)_n$—C(O)—N($R^{10}$)—$SO_2$—$(CH_2)_mH$ wherein n equals 1, 2 or 3; m equals 1, 2, 3, etc.

—$(CH_2)_r$—$SO_2$—N($R^{10}$)—$SO_2$—$(CH_2)_sH$ wherein r equals 2, 3 or 4; s equals 1, 2, 3, etc., —$(CH_2)_v$—$SO_2$—N($R^{10}$)—C(O)—$(CH_2)_wH$ wherein v equals 2, 3 or 4; w equals 1, 2, 3, etc.;

a carboxyalkyl group, preferably corresponding to the formula $(CH_2)_xCOOH$ or $(CH_2)_xCOO^-$ wherein x equals 1, 2, 3, etc.;

wherein $R^{10}$ represents H or alkyl; and wherein each of T and T' independently represents hydrogen, 5-phenyl, 5-Cl, 5-$OCH_3$ and 5-$CH_3$.

In an even more preferred embodiment in the emulsion according to the present invention the J-aggregating cyanine dye corresponds to the general formula (II) wherein $R^{11}$ is hydrogen, Z is an nitrogen atom, T represents hydrogen, 5-phenyl, 5-Cl, 5-$OCH_3$ or 5-$CH_3$ and wherein T' represents 5,6-$(Cl)_2$; 5-CN-6-Cl; 5-$CF_3$-6-Cl; 5-Cl; 5-CN, 5-$CF_3$, 5-$CHF_2$, 5-$SO_2CH_3$ or 5-$SO_2R^{12}$ ($R^{12}$ representing a fluoro-subsituted or non-fluoro-substituted alkyl group), 5-$COOR^{13}$ and 5-$SO_2$-N($R^x$) ($R^y$) or 5-CO-N($R^x$) ($R^y$), wherein $R^x$ and $R^y$ each independently represents substituted or unsubstited alkyl groups, which may form a ring with the N-atom to which they are attached.

Still more preferred in the formula (II) each of Z and Z' represents oxygen and each of T and T' represents Cl or, alternatively, T represents Cl and T' represents Phenyl or vice versa and wherein further $R^5$ and $R^6$ represent all combinations of the formulae —$(CH_2)_nSO_3^-$ wherein n equals 2, 3 or 4, —$(CH_2)_2$—$CH(CH_3)$—$SO_3^-$ and —$CH_2$—CHY—$CH_2$—$SO_3^-$ wherein Y represents —OH or —Cl;

and wherein $R^5$, corresponding to the formulae given above, is combined with $R^6$ corresponding to the formulae —$(CH_2)_jH$ wherein j equals 1, 2, 3 or 4;

—$CH_2$-Phen-$SO_3^-$

—$CH_2$-Phen-COOH

—$(CH_2)_k$-Phen-COOH wherein k equals 1, 2 or 3.

—$(CH_2)_1$—COOH, wherein 1 equals 1, 2 or 3, etc.

In a particular embodiment said J-aggregating spectrally sensitizing dye is a 5,5'-dichloro-3,3'-bis($SO_3$-R)-9-ethylbenzoxacarbocyanine with R being n-propylene or n-butylene and more particularly anhydro-5,5'-dichloro-3,3'-bis(n-sulphobutyl)-9-ethyloxacarbocyanine hydroxide or anhydro-5,5'-dichloro-3,3'-bis(n-sulphopropyl)-9-ethyloxacarbocyanine hydroxide. Furthermore green-light absorbing spectral sensitizers according to the formulae given in JP-A's 06,035,104; 06,035,101; 06,035,102; 62,191,847; 63,249,839; 01,312,536; 03,200,246; U.S. Pat. No. 4,777,125 and DE 3,819,241 may be used. The right choice of said sensitizers or combinations thereof is always related with the purpose of obtaining the highest possible photographic speed while reducing dye stain after processing.

In the context of the present invention, more particularly with respect to the purposes to get reduced dye stain azacyanine dyes are used in the preparation of {111} tabular grain emulsions as the presence of said dyes permits addition of J-aggregating spectral sensitizers, more preferably green sensitizers, in lower amounts, without loss in speed, thereby providing better decolouration in the processing. A survey of other chemical classes of J-aggregating spectral sensitizers suitable for use in spectrally sensitizing emulsions of the present invention has been described by F. M. Hamer in "The Cyanine Dyes and Related Compounds", 1964, John Wiley & Sons and other examples specifically useful for spectral sensitization of tabular grains have been given in Research Disclosure Item 22534 and in addition a more recent overview has been given in EP-A 0 757 285, filed Aug. 1, 1995, wherefrom dyes forming J-aggregates on the flat surface of the preferred silver bromide or silver bromoiodide crystals are particularly useful.

Traditionally spectral sensitization follows the completion of chemical sensitization. However, the spectral sensitization of tabular grains in particular may occur simultaneously with or even completely precede the chemical sensitization step: it is generally recognized that spectral sensitizers themselves may act as site-directors during the formation of sensitivity specks by the chemical sensitization of tabular grains, thereby enhancing their photographic properties. Within the scope of the present invention it is clear that this also applies, but that site-directing action should be performed first by azacyanine dyes before other spectrally sensitizing dyes.

It is moreover preferred that the radiation-sensitive emulsion according to the present invention has one or more azacyanine dye(s) and (a) J-aggregating spectrally sensitizing dye(s) in a ratio amount of more than 1:4 for a grain coverage exceeding 50%.

Other dyes, which per se do not have any spectral sensitization activity, or certain other compounds, which do not substantially absorb visible radiation, can have a supersensitization effect when they are incorporated together with said spectral sensitizing agents into the emulsion. Suitable supersensitizers are, i.a. heterocyclic mercapto compounds containing at least one electronegative substituent as described e.g. in U.S. Pat. No. 3,457,078, nitrogen-containing heterocyclic ring-substituted aminostilbene compounds as described e.g. in U.S. Pat. Nos. 2,933,390 and 3,635,721, aromatic organic acid/formaldehyde condensation products as described e.g. in U.S. Pat. No. 3,743,510 as well as cadmium salts and azaindene compounds.

At least one non-spectrally sensitizing dye can be added to an emulsion layer or to one or more non-light-sensitive hydrophilic layers such as the backing layer(s). The presence of such dye(s) in adapted amounts is not only recommended to adjust the sensitivity of the different emulsion layers and eventually the required contrast, but also in order to reduce scattering of exposure radiation and thus to enhance sharpness. Preferred dyes are those that are removed easily from the photographic material during wet processing in order not to leave any residual colour. When said dyes are added to the emulsion side, it may be preferred that these dyes are non-diffusible during coating of the hydrophilic layers. Examples of such dyes, without being limited thereto, are the dyes that have been described in e.g. U.S. Pat. Nos. 3,560,214; 3,647,460; 4,288,534; 4,311,787 and 4,857,446. These dyes may be added to the coating solution as a solid particle dispersions of water insoluble dyes having a mean particle diameter of less than 10 μm, more preferably less than 1 μm and still more preferably less than 0.1 μm. Examples of such dyes are disclosed in EP-A's. 0 384 633; 0 351 593; 0 586 748; 0 587 230 and 0 656 401, EP-A's. 0

323 729; 0 274 723 and 0 276 566, and in U.S. Pat. Nos. 4,900,653; 4,904,565; 4,949,654; 4,940,654; 4,948,717; 4,988,611; 4,803,150 and 5,344,749. Said dyes can also be added in form of a solid silica particle dispersion as disclosed in EP-A 0 569 074. Still another technique applied in order to obtain ultra fine dye dispersions consists in acidifying a slightly alkaline coating composition "in situ" just before coating it onto the supporting layer. A more recent review of dispersion methods, useful in the context of the present application has been described in EP-A 0 756 201.

The silver halide emulsions according to the present invention may also comprise compounds preventing the formation of a high minimum density or stabilizing the photographic properties during the production or storage of photographic materials or during the photographic treatment thereof. Many known compounds can be added as fog-inhibiting agent or stabilizer to the silver halide emulsion. Suitable examples are i.a. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methylbenzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB-A 1,203,757, GB-A 1,209,146, JP-B 77/031738 and GB-A 1,500,278, and 7-hydroxy-s-triazolo-[1,5-a]-pyrimidines as described in U.S. Pat. No. 4,727,017, and other compounds such as benzenethiosulphonic acid, benzenethiosulphinic acid and benzenethiosulphonic acid amide.

Other compounds which can be used as fog-inhibiting compounds are those described in Research Disclosure No. 17643 (1978), Chaptre VI. These fog-inhibiting agents or stabilizers can be added to the silver halide emulsion prior to, during, or after the ripening thereof and mixtures of two or more of these compounds can be used.

The binder of the layers, especially when gelatin is used as a binder, can be forehardened with appropriate hardening agents such as those of the epoxide type, those of the ethylenimine type, those of the vinylsulfone type, e.g. 1,3-vinylsulphonyl-2-propanol or di-(vinylsulphonyl)-methane, vinylsulphonyl-ether compounds, vinylsulphonyl compounds having soluble groups, chromium salts like e.g. chromium acetate and chromium alum, aldehydes as e.g. formaldehyde, glyoxal, and glutaraldehyde, N-methylol compounds as e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with the onium compounds as disclosed in EP-A 0 408 143.

According to the present invention a light-sensitive silver halide photographic film material is further provided, wherein said material comprises a support and on one or both sides thereof at least one light-sensitive emulsion layer having an emulsion as disclosed hereinbefore.

The photographic material according to the present invention may further comprise various kinds of surface-active agents in the light-sensitive emulsion layer(s) or in at least one other hydrophilic colloid layer. Suitable surface-active agents include non-ionic agents such as saponins, alkylene oxides, e.g., polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides, anionic agents comprising an acid group such as a carboxyl, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes, e.g. as coating aids, as compounds preventing electric charges, as compounds improving film transport in automatic film handling equipment, as compounds facilitating dispersive emulsification, as compounds preventing or reducing adhesion, and as compounds improving photographic properties such as higher contrast, sensitization and development acceleration. Especially when rapid processing conditions are important, development acceleration may be useful, which can be accomplished with the aid of various compounds, preferably polyoxyalkylene derivatives having a molecular weight of at least 400 such as those described in e.g. U.S. Pat. Nos. 3,038,805; 4,038,075 and 4,292,400. Especially preferred developing accelerators are recurrent thioether groups containing polyoxyethylenes as described in DE 2,360,878, EP-A's 0 634 688 and 0 674 215. The same or different or a mixture of different developing accelerators may be added to at least one of the hydrophilic layers at the emulsion side. It may be advantageous to partially substitute the hydrophilic colloid binder, preferably gelatin, of the light-sensitive silver halide emulsion layer or of an hydrophilic colloid layer in water-permeable relationship therewith by suitable amounts of dextran or dextran derivatives to improve the covering power of the silver image formed and to provide a higher resistance to abrasion in wet condition.

The photographic material of the present invention may further comprise various other additives such as compounds improving the dimensional stability of the photographic material, UV-absorbers, spacing agents, lubricants, plasticizers, antistatic agents, etc. Suitable additives for improving the dimensional stability are i.a. dispersions of a water-soluble or hardly soluble synthetic polymer e.g. polymers of alkyl (meth)acrylates, alkoxy(meth)acrylates, glycidyl (meth)acrylates, (meth)acrylamides, vinyl esters, acrylonitriles, olefins and styrenes, or copolymers of the above with acrylic acids, methacrylic acids, α-β-unsaturated dicarboxylic acids, hydroxyalkyl (meth)acrylates, sulphoalkyl (meth)acrylates, and styrene sulphonic acids.

Suitable UV-absorbers are e.g. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455.

In general, the average particle size of spacing agents is comprised between 0.2 and 10 μm. Spacing agents can be soluble or insoluble in alkali. Alkali-insoluble spacing agents usually remain permanently in the photographic material, whereas alkali-soluble spacing agents usually are removed in an alkaline processing bath. Suitable spacing agents can be made i.a. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

Compounds which can be used as a plasticizer for the hydrophilic colloid layers are acetamide or polyols such as trimethylolpropane, pentanediol, butanediol, ethylene glycol and glycerine. Further, a polymer latex is preferably incorporated into the hydrophilic colloid layer for the purpose of improving the anti-pressure properties, e.g. a homopolymer of acrylic acid alkyl ester or a copolymer thereof with acrylic acid, a copolymer of styrene and butadiene, and a homopolymer or copolymer consisting of monomers having an active methylene group.

The photographic material according to the present invention may comprise an antistatic layer to avoid static discharges during coating, processing and other handling of the material. Such antistatic layer may be an outermost coating like the protective layer or an afterlayer or a stratum of one or more antistatic agents or a coating applied directly to the film support or other support and overcoated with a barrier or gelatin layer. Antistatic compounds suitable for use in such layers are e.g. vanadium pentoxide soles, tin oxide soles or conductive polymers such as polyethylene oxides or a polymer latex and the like.

Preferably,the photographic materials according to the present invention are characterized by a neutral silver image tone, obtained after exposure and processing. It is well known that thin tabular emulsion grains may produce a brownish, yellow or even reddish image tone and therefore, tabular grains having an average thickness of 0.2 μm or more are preferred. On the other hand, a thickness between 0.20 and 0.3 μm may is not always preferred since thicker grains are characterized by a lower covering power of the developed silver, requiring a large amount of silver halide in the photographic material in order to obtain a satisfactory maximum density. Methods to prepare thicker tabular grains may however be applied as has already been described in U.S. Pat. Nos. 4,801,522; 5,028,521 and 5,013,641 and EP-A 0 569 075.

The non-neutral silver image colour can be corrected by increasing the optical density in the red region of the visible spectrum by adding suitable dyes to the support or any coated layer.

This non-image wise colour correction method has been disclosed in references as e.g. JP-A's 03100645; 01029838; 01312536; 03103846; 03094249; 03255435; 61285445; EP-A 0 271 309 and in U.S. Pat. No. 4,861,702. This method however may result in an excessive base+fog density of the photographic material and therefore, an alternative way consists in an image-wise colour correction by using colour-forming developers, which are blue coloured in their oxidized form. Examples thereof are summarized in JP-A 03153234; 03154043 and 03154046. In JP-A's 03156447 and 03157645 the adsorption of a blue coloured dye as a function of exposure has further been disclosed.

Another method to improve the image tone of tabular grain emulsions consists of mixing them with cubic grains containing chloride as disclosed in EP-A 0 770 909. In addition, the photographic material according to the present invention may comprise preferably in the emulsion layer(s) a compound corresponding to the following formula:

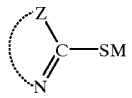

wherein Z represents a group of atoms necessary to form a 5- or 6-membered ring and M represents a hydrogen atom, an alkali metal atom or an ammonium group. The compounds of the above formula are preferably added in an amount from $10^{-6}$ to $10^{-2}$, more preferably $10^{-5}$ to $10^{-3}$ mole per mole of silver in the emulsion layer(s). Representative examples of these compounds are given in U.S. Pat. No. 5,290,655.

According to the present invention a photographic material is thus provided comprising a support and coated thereon on at least one side one or more hydrophilic light-sensitive layers, wherein at least one of said layers comprises a silver halide emulsion as disclosed hereinbefore. This material may be used in colour photography or black-and-white photography, as in micrographic films, aviation photography, cinefilm, hardcopy films, non-destructive testing applications, laserfilms, graphic and reprographic films, and in radiography.

More preferably according to the present invention said photographic material comprises on only one side of the support only one hydrophilic light-sensitive layer comprising an emulsion as disclosed herein, wherein light-sensitive tabular grains have a coverage of from 3.0 to 9.0 g/m$^2$, more preferably from 5.0 to 9.0 g/m$^2$, expressed as silver nitrate. The said material is particularly suitable for use in radiographic applications, and, more preferably, in mammographic applications.

According to the present invention radiographic screen/film combinations comprising a light-sensitive silver halide photographic film material as disclosed hereinbefore is provided and a supporting or self-supporting X-ray intensifying screen, characterized in that said supported or self-supporting X-ray intensifying screen essentially consists of luminescent phosphor particles emitting green light. In a preferred embodiment a radiographic screen/film combination is provided wherein said luminescent phosphor is $Gd_2O_2S$:Tb. Moreover a radiographic screen/film combination is provided wherein the total amount of coated silver halide in said film, expressed as an equivalent amount of silver nitrate, is less than 7.5 g/m$^2$.

For processing, preferably an automatically operating apparatus is used provided with a system for automatic replenishment of the processing solutions. The processing dry-to-dry within a short processing time of from 30 to 90 seconds and more preferably from 30 seconds to less than 60 seconds of materials coated from low amounts of silver is made possible by the steps of developing said material in a developer without hardening agent;

fixing said material in a fixer, optionally without hardening agent;

rinsing and drying said material.

A normally used configuration in the processing apparatus shows the following consecutive tank units corresponding with, as consecutive solutions: developer-fixer-rinse water. Recent developments however have shown, that from the viewpoint of ecology and especially with respect to reduction of replenishing amounts, as consecutive solutions the sequence developer-fixer-fixer-rinse water-rinse water is preferred. One washing step between developing and fixation and one at the end before drying may also be present.

As ecology and low replenishing amounts are main topics with respect to the present invention use is made of concentrated hardener free processing solutions in one single package. Examples thereof have been disclosed e.g. in U.S. Pat. Nos. 5,187,050 and 5,296,342. Especially preferred developers comprising ecologically acceptable developing agents such as ascorbic acid and derivatives thereof have been described in EP-A 0 732 619 and in U.S. Pat. Nos. 5,236,816; 5,593,817 and 5,604,082. Instead of or partially substituting (e.g. in a ratio by weight of from 1:1 up to 9:1) the ecologically questionable "hydroquinone" (iso)ascorbic acid, 1-ascorbic acid and tetramethyl reductic acid are preferred as main developing agent in the developer. Said developing agents have further been described in EP-A's 0 461 783, 0 498 968, 0 690 343, 0 696 759, 0 704 756, 0 732 619, 0 731 381 and 0 731 382; in U.S. Pat. Nos. 5,474,879 and 5,498,511 and in Research Disclosure (further called "RD") No 371052, published Mar. 1, 1995, wherein a more general formula covering the formula of said developing agents has been represented. In order to reduce "sludge formation" which is favoured by solubilizing agents like sulphites, present in the developer as preservatives, a particularly suitable developer solution is the one comprising a reduced amount of sulphite and ascorbic acid which acts as a main developer and anti-oxidant as well and which is called "low-sludge" developer as has e.g. been described in EP-A 0 851 282 and in EP-Applications Nos. 98203412 and 98204079, filed Oct. 8 and Nov. 30, 1998, respectively.

In favour of ecological fixation the presence of aluminum ions should be reduced, and more preferably, no aluminum ions should be present. This is moreover in favour of the absence of "sludge" formation, a phenomenon which leads to pi-line defects when high amounts of silver are coated in the light-sensitive layers. Measures in order to reduce "sludge-formation" have further been described in U.S. Pat. Nos. 5,447,817; 5,462,831 and 5,518,868. A particularly suitable fixer solution comprises an amount of less than 25 g of potassium sulphite per liter without the presence of acetic acid wherein said fixer has a pH value of at least 4.5, in order to make the fixer solution quasi odourless as illustrated in EP-A 0 908 764.

If however aluminum ions are present in the fixer composition for whatever a reason, the presence of a-ketocarboxylic acid compounds is recommended as has been described in EP-A's 0 620 483 and 0 726 491 as well as in RD No. 16768, published March 1978.

It is possible to use sodium thiosulphate as a fixing agent, thus avoiding the ecologically undesirable ammonium ions normally used. For low coating amounts of emulsion crystals rich in chloride a fixation time which is reduced to about 2 to 10 seconds can be attained. Moreover regeneration is kept to a minimum, especially in the processing of materials coated from very low amounts of emulsion crystals rich in silver chloride. Preferred minimum regeneration or replenishment amounts are from 20 to 200 ml/m$^2$ , more preferred from 20 to 100 ml/m$^2$, and still more preferred from 20 to 50 ml/m$^2$ of developed material. Materials coated from higher amounts of silver will require the higher amounts of replenisher but in most practical cases replenishment amounts of less than 200 ml/m$^2$ are attainable.

Replenishment of a developer comprising ascorbic acid or derivatives thereof and a 3-pyrazolidone derivative has been described in EP-A 0 573 700, wherein a method is disclosed for processing with constant activity image-wise exposed silver halide photographic material comprising the steps of developing photographic material in a continuous automatic way by means of a developing solution containing an ascorbic acid analogue or derivative and a 3-pyrazolidone derivative as developing agents and replenishing said developing solution by means of at least one replenishing solution having a higher pH than the developing solution. In an alternative method the replenisher is added as a powder. Other references related therewith are EP-A 0 552 511; U.S. Pat. No. 5,503,965 and further in EP-A 0 660 175, wherein a method of replenishment control is described. For the fixer preferred minimum regeneration or replenishment amounts are also from about 20 to 200 ml/m$^2$, more preferred from 20 to 100 ml/m$^2$ and still more preferred from 20 to 50 ml/m$^2$ of developed material. When aluminum ions are present in the fixer solution in order to effect hardening, it is necessary to adjust the pH of the fixer in the range from 4.2 to 4.6 in order to get the highest hardening reactivity and to suppress swelling with washing water in the washing or rinsing step. For hardened materials having a swelling degree of the hydrophilic layers of less than 250% and more preferably of less than 200% it is not required for the fixer pH to held constant in the pH range from 4.2 to 4.6 as mentioned before: in order to reduce irritating smell from sulphite ions in aqueous acidic medium which lead to sulphur dioxide vapour it is recommended to enhance pH to a value of 4.65 up to 5.00. A process whereby the quality of the fixer remains at an optimum level has been described in EP-A 0 872 764.

Although it is possible to use whatever a processing unit adapted to the requirements described hereinbefore to reach the objectives concerning a perfect link between rapid processing and ecology, the objects of this invention concerning processing have e.g. been realised in the processing unit CURIX HT 530, trade name product marketed by Agfa-Gevaert.

Further, according to the present invention, particularly with respect to mammographic applications a radiological method for obtaining a diagnostic image for mammography is offered, said method comprising the steps of (i) composing a film-screen system according to the present invention by bringing a photographic material as disclosed hereinbefore into contact with a radiographic X-ray conversion screen; and (ii) subjecting said film-screen system to exposure with X-rays, emitted from an X-ray generating device with a tube voltage of 20 kV to 40 kV; and (iii) processing said photographic material in a total dry-to-dry processing time of from 38 seconds up to 210 s, and more preferably in a time of from 45 s up to 90 s, by the steps of developing, fixing, rinsing or washing and drying.

According to the present invention, the same method is applied with respect to e.g. chest-imaging applications, apart for (i) composing a film-screen system according to the present invention by bringing a duplitized or double-side coated photographic material into contact with a pair of radiographic X-ray conversion screens; and (ii) subjecting said film-screen system to exposure with X-rays, emitted from an X-ray generating device with a tube voltage of 70 kV to 100 kV; the processing step remaining the same.

Having described in detail preferred embodiments of the present invention it is understood by a person skilled in the art that, within the scope of the present invention, it is not limited thereto.

EXAMPLES

Example 1

Preparation of Tabular Emulsion TC1 (comparative emulsion)

To a solution of 5.5 g of an oxidized gelatin in 3 l of demineralized water, adjusted to a pBr of 2.39 by adding KBr and a pH of 1.8 by adding $H_2SO_4$, were added by a double jet method aqueous solutions of 1.96 M $AgNO_3$ (hereinafter referred to as A1) and 1.96 M KBr (hereinafter referred to as B1): 8 ml of A1 and 8 ml of B1 were added in a time interval of 30 seconds. During this period, the reaction mixture was maintained at 51° C. When the addition was completed, stirring continued during 90 seconds and then, temperature was increased up to 70° C. over a period of 25 minutes, followed by the addition, after another time of 210 seconds, of 500 ml of an aqueous gelatinous solution of 10 wt % of gelatin. After another time interval 330 seconds after said addition a NaOH solution was added over a time period of one minute in order to adjust pH to 6.0. Then stirring continued for 6 minutes at a temperature held constant at 70° C. and B1 was added by a single jet at 7.5 ml/min over a period of 330 seconds. Then A1, at a constant flow rate of 7.5 ml/min, and B1 at a flow rate, controlled in order to maintain pAg at 8.85, were added in a double jet over a period of 1 minute. This double jet was continued during another period of 2002 seconds, while the flow rate of A1 was linearly increased up to 22.5 ml/min and pAg was maintained at 8.85. This period was called "first growth step". 5 minutes after the completion of said double jet addition, A1 was added at 7.5 ml/min during 440 seconds. Then another double jet started of A1 at 7.5 ml/min during 100 seconds and an aqueous solution of 1.93 M KBr and 0.03 M KI (solution B2) at a controlled flow rate to maintain pAg at 7.38. This double jet was continued during another period of 2456 seconds, while the flow rate of A1 was linearly increased from said 7.5 ml/min up to 36.9 ml/min and pAg was maintained at 7.38. The average grain size of the silver bromoioide tabular {111} emulsion grains thus prepared, expressed as equivalent volume diameter, was 0.75 $\mu$m, the average thickness was 0.18 $\mu$m. The iodide content was 1 mol %.

After washing, gelatin and water were added in order to obtain a silver halide content of 245 g/kg, expressed as $AgNO_3$, and a gelatin content of 83 g/kg. To 2 kg of this emulsion, of which pH was adjusted to 5.5, were added consecutively 4 ml of a 10 wt. % KSCN solution, 0.2 ml of a $4.76\times10^{-3}$ M solution of sodium toluenethiosulphonate in methanol, y ml of compound (II.3 but with the tosyalate anion of compound II.5) (0.1 wt %) followed by addition after 30 minutes of x ml of a 0.25 wt. % solution of anhydro-5,5'-dichloro-3,3'-bis(n-butyl-4-sulphonate)-9-ethyl-benzoxa-carbocyanine triethylammonium salt, (amounts of y and x as in Table 3, given hereinafter), 9 mg sodium thiosulphate (0.1 wt. %), 10 ml of a solution containing $1.456\times10^{-3}$ M chloro auric acid and $1.58\times10^{-2}$ M ammonium rhodanide, and finally 10 ml of a 1 wt. % solution of 1-(p-carboxyphenyl)-5-mercapto-tetrazole and this mixture was chemically ripened during 4 hours at 48° C. After cooling, a preservative was added.

Following coating agents, summarized in Table 1, were added to the emulsion before coating the emulsion layer:

TABLE 1

| Compound (amounts per mole silver halide) | Emulsion layer |
|---|---|
| 5,5'-dichloro-3,3'-bis(n-butyl-4-sulphonate)-9-ethylbenzoxacarbocyanine, anhydrous triethylammonium salt | 50 mg |
| 4-hydroxy-6-methyl-1,3,3a,7-tetraazaindene | 87 mg |
| bis-metasulphophenyl-disulphide | — |
| 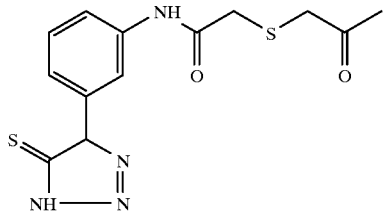 | 33 mg |
| sorbitol | 15.5 g |
| polyethylacrylate, latex plasticizer | 12 g |
| phloroglucinol | 195 mg |
| resorcinol | 2.8 g |
| potassium bromide | 160 mg |
| polydextran (M.W. 10,000) | 15 g |

Following coating agents, summarized in Table 2, were added to the protective coating before coating the protective antistress layer:

TABLE 2

| Compound | amounts per $m^2$ |
|---|---|
| gelatin | 1.1 g |
| polymethylmethacrylate spacing agent (average particle diameter 3 $\mu$m) | 15 mg |
| chromium acetate | 5.5 mg |
| 4-hydroxy-6-methyl-1,3,3a,7-tetraazaindene | 82 mg |
| bis-metasulphophenyl-disulphide | 4 mg |
| $CF_3$—$(CF_2)_6$—COOH.NH3 | 7.5 mg |
| $CF_3$—$(CF_2)6$—CONH—$(CH_2CH_2O)_{17-20}$—H | 19 mg |
| phenol | 150 mg |
| 1-phenyl-4-methyl-3-pyrazolidone | 0.13 mg |
| Mobilcer Q (a paraffin wax, trade name product from MOBIL OIL) | 25 ml |
| polythioether A [a] | 5 mg |
| formaldehyde (added just before coating) | 100 mg |

[a] Polythioether A is a modified poly-epichloorhydrine having an average chain length of approximately 20 monomer units and of which about 50% of the chloride groups have been replaced by a —S—$CH_2$—CHOH—$CH_2$OH substituent.

The photographic materials according to these examples comprise one emulsion layer and one protective layer. The coating solutions of the emulsion layers were prepared by adding solutions of the compounds indicated in Table 1 to the melted emulsion while stirring. The coating solution of the protective layer is given in Table 2.

After adjusting pH to 6.7, the viscosity and surface tension of the coating solutions were optimised according to the requirements of the coating method. The emulsion layer(s) and the protective layer were coated simultaneously on one side of a substrated polyester support having a thickness of 175 $\mu$m by means of conventional coating techniques. The silver coverage of the emulsions was about 7 g/$m^2$, expressed as an equivalent amount of silver nitrate.

Separate strips of the coated materials were subsequently exposed for the same exposure time of 2 seconds to white light, filtered with a U535-green light filter. Development proceeded for 12 seconds in a developer having the following composition:

| | |
|---|---|
| hydroquinone | 30 g |
| 1-phenyl-pyrazolidine-3-one | 1.5 g |
| acetic acid 99% | 9.5 ml |
| potassiumsulphite | 63.7 g |
| potassiumchloride | 0.8 g |
| EDTA-2Na | 2.1 g |
| potassium carbonate | 32 g |
| potassiummetabisulfite | 9 g |
| potassium hydroxyde | 14 g |
| diethyleneglycol | 25 ml |
| 6-methylbenztriazol | 0.09 g |
| glutardialdehyde 50 wt% | 9.5 ml |
| 5-nitroindazole | 0.25 g |
| demineralized water to make 1 1. | |

The starter solution to be added had the following composition:

| | |
|---|---|
| acetic acid 99% | 15.5 ml |
| KBr | 16 g |
| demineralized water | up to 100 ml |

Hereupon, the developed photographic strips were fixed in a conventional fixing bath comprising e.g. sodium thiosulfate and potassium metabisulfite, and then rinsed in water and allowed to dry. Sensitometric properties of these film strips are given in Table 3, wherein the sensitometric results have been shown in terms of speed S (figures multiplied with a factor of 100: the lower the figure, the more sensitive is the emulsion), overall contrast GG and residual colouration (dye "STAIN": "NO" or "YES") obtained by developing in a developer the composition of which has been set forth above during an overall developing time of 12 seconds.

For the overall contrast GG the gradation was measured from the characteristic curve over a density range of 1.75 starting from a density value of 0.25 up to 2.00 above fog. Gradation values have been multiplied by a factor of 100.

amounts of dyes x and y have been expressed in ml of the solution per 500 g of silver nitrate.

TABLE 3

| Matl.No. | x | y | S | GG | STAIN |
|---|---|---|---|---|---|
| TC1 | 780 | 0 | 130 | 235 | YES |
| TC2 | 600 | 0 | 131 | 264 | YES |
| TC3 | 450 | 0 | 190 | 210 | NO |
| TI1 | 300 | 75 | 148 | 245 | NO |
| TI2 | 450 | 37.5 | 134 | 268 | NO |
| TI3 | 450 | 82.5 | 143 | 283 | NO |

As can be concluded from the Table 3 the presence in the light-sensitive silver halide photographic emulsions, more particularly in {111} tabular emulsions having grains rich in silver bromide, of green sensitizer in amounts x per 500 g of silver nitrate, and an azacyanine compound in amounts y per 500 g of silver nitrate, leads to a the desired contrast without loss in speed, if in the presence of remarkably lower amounts of green sensitizing dye an azacyanine compound has been added to the tabular grains (see inventive emulsions TI1–TI3).

Residual colour (dye stain) can thus be lowered by addition of lower amounts of green-sensitizing dye (see comparative materials TC1–TC3 but, accordingly, speed and contrast also lowered. The presence of azacyanine compounds added before green-sensitizing dyes however permits use of said lower amounts of said green-sensitizing dye without significant loss in speed or contrast.

Example 2

Preparation of Tabular Emulsion TI5

To a solution of 5.5 g of an oxidized gelatin in 3 1 of demineralized water at 51° C., adjusted to a pH of 2.5 by adding $H_2SO_4$, stirred up to a rate of 600 r.p.m., were added by a double jet method aqueous solutions of 1.96 M $AgNO_3$ (hereinafter referred to as A1) and 1.96 M KBr (hereinafter referred to as B1): 16 ml of A1 and 16 ml of B1 were added in a time interval of 30 seconds. During this period, the reaction mixture was maintained at 51° C. When the addition was completed, stirring continued during 60 seconds, UAg was measured (normal value 28 mV±5 mV vs. a Ag/AgCl(sat.) reference electrode and 6 minutes later, temperature was increased up to 70° C. over a period of 25 minutes: UAg was controlled again and should be in the range from 40.1±5 mV at a temperature of 70° C.±1° C. 6 minutes later pH was set to a value of 5.0±0.3 and immediately thereafter a solution of 50 g of inert gelatin in 500 ml of demineralized water of 70° C. was added. 330 seconds later B1 was added at a rate of 7.5 ml/min. during 148 seconds, followed during 1 minute by the simultaneous addition of A1 (at a rate of 7.5 ml/min.) and B1 (at a rate of 7.6 ml/min.) during 60 seconds. In a further double jet addition A1 and B1 were added during 2675 seconds at a linearly increasing rate going from 7.5 up to 15 ml/min. for A1 and from 7.6 up to 15.21 ml/min. in order to maintain a constant UAg potential of +10 mV in the reaction vessel. After 5 minutes A1 was added during 263 seconds at a rate of 7.5 ml/min. in order to increase the UAg value to 60 mV. At that moment a further double jet addition was performed for 100 seconds at a rate of 7.5 ml/min., whereafter the rate was increased linearly during 2518 seconds up to 36.8 ml/min. for A1 and up to 36.73 ml/min. for B1 in order to hold a constant Uag potential of +60 mv in the reaction vessel.

When said double jet addition was running 4 minutes an amount of an emulsion, dissolved in 20 g of demineralized water at 40° C., having ultrafine (ca. 0.050 μm) 100% AgI crystals was added to the reaction vessel in order to get a total AgI content at the end of precipitation of 1 mole % vs. silver precipitated.

After a physical ripening time of 20 min. stirring was ended in the reaction vessel.

The average grain size of the silver bromoioide tabular {111} emulsion grains thus prepared, expressed as equivalent volume diameter, was 0.57 μm, the average thickness was 0.16 μm.

After washing, gelatin and water were added in order to obtain a silver halide content of 236 g/kg, expressed as $AgNO_3$, and a gelatin content of 74 g/kg. To 3370 g of this emulsion, of which pH was adjusted to 5.5, were added consecutively 4 ml of a 10 wt. % KSCN solution, 0.2 ml of a $4.76\times10^{-3}$ M solution of sodium toluenethio-sulphonate in methanol, y ml of compound (II.3 but with the tosylate anion of compound II.5) (0.4 wt %) followed by addition after 30 minutes of 1200 ml of a 0.25 wt. % solution of anhydro-5, 5'-dichloro-3,3'-bis(n-propyl-3-sulphonate)-9-ethyl-benzoxa-carbocyanine triethylammonium salt, 7 mg (5 mg in the alternative as indicated in the Table 4 as amounts of w, expressed in mg) sodium thiosulphate (0.1 wt. %), w' ml of a 0.001 wt. % solution of 2-carboxyethyl-N-benzothiazine selenide, z ml of a solution containing $1.456\times10^{-3}$ M chloro auric acid and $1.58\times10^{-2}$ M ammonium rhodanide, and finally 10 ml of a 1 wt. % solution of 1-(p-carboxyphenyl)-5-mercapto-tetrazole and this mixture was chemically ripened during 4 hours at 50° C. After cooling, a preservative was added.

Coating of the Materials

Preparation of the Film Material

Before coating each emulsion was stabilized with 1-p-carboxyphenyl-5-mercaptotetrazole and after addition of the normal coating additives the solutions were coated simultaneously together with a protective layer containing 1.3 g gelatine per $m^2$ per side on both sides of a polyethylene terephthalate film support having a thickness of 175 $\mu$m. The resulting photographic material contained per side an amount of silver halide corresponding to an amount of x' grams of silver per $m^2$ as indicated in Table 4. Materials have been numbered from 1 to 15.

Samples of these coatings were exposed with green light of 540 nm during 0.1 seconds using a continuous wedge and were processed.

The processing was run in the developer A the composition of which is given hereinafter, followed by fixing in fixer A' (see composition given hereinafter) and rinsing at the indicated temperature of 35° C. for a total processing time of 45 seconds.

| Developer A | |
|---|---|
| 1-phenyl-4-methyl-4'hydroxy-methyl-pyrazolidine-3-one | 2 g |
| Hydroxyethyldiphosphonic acid (60%) | 0.9 ml |
| Trilon B | 4g |
| Potassium bromide | 1 g |
| Potassium thiocyanate | 1 g |
| Potassium metabisulphite | 23 g |
| Potassium carbonate | 125 ml |
| Polyglycol (M.W. = ca. 400) | 20 ml |
| 2-Methyl-benzotriazole | 0.03 g |
| Ascorbic Acid | 61.5 g |
| pH ready-for-use | 9.65 |

| Fixer A' | |
|---|---|
| -Ammonium thiosulphate (60% solution, wherein 1 ml comprises 0.778 g) | 710 ml |
| -Sodium metabisulphite | 80 g |
| -Sodium acetate | 130 g |
| -Acetic acid | 31 ml |
| pH ready-for-use (after dilution 1 + 3) | 4.90 |

In Table 4 the sensitometric results obtained are given.

The density as a function of the light dose was measured and therefrom were determined the following parameters:

fog level F (with an accuracy of 0.001 density), multiplied by a factor of 1000;

the relative speed S at a density of 1 above fog (an increase of the said speed with a factor of 2 gives a speed value that is 0.30 lower as the relation is logarithmic and as less light is needed to get the desired density), multiplied by a factor of 100;

the contrast expressed as gradation G1, calculated between the densities 0.1 and 1.0 above fog, multiplied by a factor of 100;

the contrast expressed as gradation G2, calculated between the densities 0.25 and 2.0 above fog, multiplied by a factor of 100.

TABLE 4

| Matl. No | F | S | G1 | G2 | J-aggr A546 nm | y | w | w' | z | x' (g/m²) |
|---|---|---|---|---|---|---|---|---|---|---|
| 1 | 206 | 147 | 193 | 318 | 1.50 | 0 | 7 | 8 | 6.5 | 5.28 |
| 2 | 203 | 152 | 203 | 327 | 1.45 | 0 | 5 | 8 | 6.5 | 5.29 |
| 3 | 199 | 147 | 198 | 326 | 1.40 | 18 | 5 | 8 | 6.5 | 5.31 |
| 4 | 195 | 147 | 199 | 319 | 1.41 | 0 | 7 | 8 | 6.5 | 5.33 |
| 5 | 197 | 157 | 196 | 318 | 1.42 | 0 | 7 | 8 | 10 | 5.36 |
| 6 | 197 | 160 | 197 | 315 | 1.46 | 0 | 7 | 8 | 15 | 5.46 |
| 7 | 196 | 165 | 197 | 311 | 1.40 | 0 | 7 | 8 | 20 | 5.33 |
| 8 | 196 | 171 | 197 | 307 | 1.42 | 0 | 7 | 8 | 30 | 5.40 |
| 9 | 195 | 156 | 206 | 342 | 1.43 | 18 | 7 | 8 | 15 | 5.38 |
| 10 | 191 | 169 | 198 | 309 | 1.40 | 18 | 5 | 8 | 15 | 5.41 |
| 11* | 199 | 150 | 201 | 332 | 1.45 | 18 | 5 | 8 | 15 | 5.43 |
| 12* | 199 | 155 | 203 | 336 | 1.43 | 18 | 5 | 8 | 30 | 5.43 |
| 13 | 196 | 229 | 112 | 180 | 1.41 | 0 | 7 | 4 | 6.5 | 5.54 |
| 14 | 202 | 160 | 187 | 283 | 1.40 | 0 | 11 | 8 | 6.5 | 5.52 |
| 15 | 197 | 165 | 196 | 287 | 1.40 | 0 | 7 | 4 | 6.5 | 5.54 |

*Chemical ripening at 56° C. instead of 50° C.

From Table 4 it can be concluded that the presence of an azacyanine compound (in amounts indicated under "y") permits the use lower amounts of sulphur (amounts indicated under "w") if sensitometric results obtained for Materials Nos. 1–3 are compared.

An increase of amounts of gold (amounts indicated under "z") makes speed and contrast decrease, unless use has been made from an azacyanine compound (compare sensitometric results obtained for Materials Nos. 4–8): no loss in speed is observed and gradation even tends to increase. A higher chemical ripening temperature moreover permits the use of higher amounts of gold and lower amounts of sulphur in the presence of an azacyanine compound (compare sensitometric results obtained for Materials Nos. 9–12).

The presence of an azacyanine compound clearly permits the use of lower amounts of chemical ripening agents (compare sensitometric results obtained for Materials Nos. 13–15).

It is further clear from the data given in Table 4 that a negligible influence is measured on the absorption of the J-aggregate of the spectral sensitizing anhydro-5,5'-dichloro-3,3'-bis(n-propyl-3-sulphonate)-9-ethyl-benzoxacarbocyanine triethylammonium compound, provided that the azacyanine compound is not present in a molar ratio amount of more than 1:4 versus the spectral sensitizer.

Example 3

Preparation of Tabular Emulsion TI4

To a solution of 4.8 g of an oxidized gelatin in 3 1 of demineralized water at 45° C., adjusted to a pH of 2.5 by adding $H_2SO_4$, stirred up to a rate of 600 r.p.m., were added by a double jet method aqueous solutions of 0.98 M $AgNO_3$ (hereinafter referred to as A1) and 0.98 M KBr (hereinafter referred to as B1): 25 ml of A1 and 25 ml of B1 were added in a time interval of 30 seconds. During this period, the reaction mixture was maintained at 45° C. When the addition was completed, stirring continued during 60 seconds, UAg was measured (normal value 28 mV±5 mV vs. a Ag/AgCl(sat.) reference electrode and 2 minutes later, temperature was increased up to 70° C. over a period of 32 minutes: UAg was controlled again and should be in the range from 44.5±5 mV at a temperature of 70° C.±1° C. 1 minute later pH was set to a value of 5.0±0.3. Immediately thereafter a solution of 50 g of inert gelatin in 500 ml of demineralized water of 70° C. was added. After 180 seconds a simultaneous addition of A1 (at a rate of 7.0 ml/min.) and B1 (at a rate of 7.06 ml/min.) during 120 seconds was following. In a further double jet addition A1 and B1 were added during 2822 seconds at a linearly increasing rate going from 7.0 up to 21.11 ml/min. for A1 and from 7.06 up to 21.29 ml/min. in order to maintain a constant UAg potential of +40 mV in the reaction vessel. After 5 minutes A1 and B1 were further added in a double jet precipitation step during 60 seconds at a rate of 10.0 and 10.04 ml/min., followed by double jet addition 4865 seconds at a rate linearly increasing up to 46.49 ml/min. for A1 and up to 46.69 ml/min. for B1 in order to hold a constant Uag potential of +50 mV in the reaction vessel.

When said double jet addition was running 54 minutes an amount of an emulsion, dissolved in 20 g of demineralized water at 40° C., having ultrafine (ca. 0.050 $\mu$m) 100% AgI crystals was added to the reaction vessel in order to get a total AgI content at the end of precipitation of 1 mole % vs. silver precipitated. After a physical ripening time of 20 min. stirring was ended in the reaction vessel.

The average grain size of the silver bromoioide tabular {111} emulsion grains thus prepared, expressed as equivalent volume diameter, was 0.46 $\mu$m, the average thickness was 0.16 $\mu$m.

After washing, gelatin and water were added in order to obtain a silver halide content of 230.5 g/kg, expressed as $AgNO_3$, and a gelatin content of 72.6 g/kg. To 3442 g of this emulsion, of which pH was adjusted to 5.5, were added consecutively 4 ml of a 10 wt. % KSCN solution, y ml (0.1 wt. %) of compound II.3 (but with the tosylate anion of compound II.5), followed after 5 minutes by addition of 0.2 ml of a $4.76\times10^{-3}$ M solution of sodium toluenethiosulphonate in methanol. After 5 minutes an addition of 1200 ml of a 0.25 wt. % solution of anhydro-5,5'-dichloro-3,3'-bis(n-propyl-3-sulphonate)-9-ethyl-benzoxa-carbocyanine triethylammonium salt, 10 mg (5 mg in the alternative as indicated in the Table 5 as amounts of w, expressed in mg) of sodium thiosulphate (0.1 wt. %), w' ml of a 0.001 wt. % solution of 2-carboxyethyl-N-benzothiazine selenide, z ml of a solution containing $1.456\times10^{-3}$ M chloro auric acid and $1.58\times10^{-2}$ M ammonium rhodanide, and finally 10 ml of a 1 wt. % solution of 1-(p-carboxyphenyl)-5-mercapto-tetrazole and this mixture was chemically ripened during 3 hours at 56° C. After cooling, a preservative was added.

Preparation of the film materials and coating of the materials was performed in the same way as for the Materials in Example 2 as well as exposure, processing and sensitometric evaluation. The results for the Materials Nos. 16–21 are represented in Table 5, wherein all symbols have the same meaning as in Table 4.

TABLE 5

| Matl. No | F | S | G1 | G2 | x' g/m$^2$ | J-aggr A546 nm | y | w | w' | z |
|---|---|---|---|---|---|---|---|---|---|---|
| 16 | 320 | 169 | 152 | 229 | 5.11 | 1.58 | 0 | 10 | 11.5 | 7 |
| 17 | 189 | 267 | 103 | 200 | 5.06 | 1.51 | 0 | 5 | 5.5 | 7 |
| 18 | 208 | 168 | 160 | 229 | 5.08 | 1.42 | 36 | 5 | 5.5 | 7 |
| 19 | 201 | 178 | 160 | 260 | 5.08 | 1.58 | 0 | 10 | 11.5 | 30 |

TABLE 5-continued

| Matl. No | F | S | G1 | G2 | x' g/m$^2$ | J-aggr A546 nm | y | w | w' | z |
|---|---|---|---|---|---|---|---|---|---|---|
| 20 | 193 | 206 | 149 | 232 | 5.03 | 1.55 | 0 | 5 | 5.5 | 30 |
| 21 | 225 | 162 | 166 | 247 | 5.06 | 1.41 | 36 | 5 | 5.5 | 30 |

From Table 5 it can be concluded again that the presence of an azacyanine compound as an agent having site-directing properties (added in amounts indicated under "y") permits use of lower amounts of sulphur (amounts indicated under "w") and/or selenium (amounts indicated under "w'") if sensitometric results obtained for Materials Nos. 16–18 and for Materials Nos. 19–21 are compared.

An increase of amounts of gold (amounts indicated under "z") makes speed and contrast increase, more particularly when use has been made from an azacyanine compound (compare sensitometric results obtained for Materials Nos. 16 and 19, 17 and 20 and 18 and 21): no loss in speed is observed and gradation even tends to increase provided that lower amounts of sulphur and selenium are used in the chemical ripening. The presence of an azacyanine compound in higher amounts than in Example 2 brings about a relatively strong decrease of the absorption of the J-aggregate of the spectral sensitizing anhydro-5,5'-dichloro-3,3'-bis(n-propyl-3-sulphonate)-9-ethyl-benzoxa-carbocyanine triethylammonium compound. An efficient site-directing action of the azacyanine compound in the chemical ripening of the {111} tabular grains of the emulsion is thus acknowledged.

What is claimed is:

1. Spectrally sensitized emulsion sensitive to irradiation wherein said emulsion comprises {111} tabular silver halide grains rich in silver bromide having an average aspect ratio of at least 2 with two flat parallel {111} crystal faces accounting for a total projective surface of said parallel crystal faces in said emulsion of at least 50%, characterized in that a site-directing compound is present, satisfying the general formula (I.1) or (I.2)

(I.1)

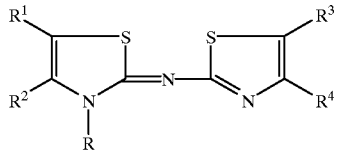

(I.2)

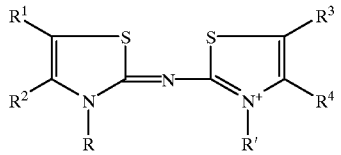

wherein each of the substituents $R^1$–$R^4$ independently represents hydrogen, an alkyl, an aryl or an alkyl;

wherein $R^1$ and $R^2$ and/or $R^3$ and $R^4$ may form a benzoring, which, if substituted, has the same or different substituents as $R^1$–$R^4$;

wherein R represents an alkyl, an aryl or an aralkyl group;

wherein R' represents hydrogen, an alkyl, an aryl or an aralkyl group; and wherein cations or anions are present as charge compensating ions.

2. Emulsion according to claim 1, wherein in formula (I.1) or (I.2) each of R and R' independently represents $(CH_2)_nH$ or $(CH_2)_nOH$, n being an integer having a value from 1 to 4;

$(CH_2)_m(SO_3^-)$ or $(CH_2)_mO(SO_3^-)$, m being an integer having a value from 2 to 4;

$(CH_2)_2CH(Y)SO_3^-$ wherein Y represents $CH_3$—, —Cl or —OH;

$(CH_2)_mN(R)SO_3^-$ or $(CH_2)_mN(R')SO_3^-$;

$(CH_2)_n(COO^-)$ or $(CH_2)_n(COOH)$;

$(CH_2)_sSO_2^-(CH_2)_tH$ wherein s equals 2 or 3 and t equals 1 or 2;

$(CH_2)_x$-Phen-W, wherein W represents —$COO^-$ or $SO_3^-$; Phen represents phenyl and x equals 1, 2, 3 or 4;

$(CH_2)_nCONHSO_2R$ or $(CH_2)_nCONHSO_2R'$, provided that R' may represent hydrogen; or $(CH_2)_m$—(C=O)—O—$CH_2$—(C=O)—$CH_3$, wherein m' is an integer having a value of from 1 to 5.

3. Emulsion according to claim 1, wherein said {111} tabular silver halide grains have an aspect ratio of at least 5:1, an average crystal diameter between 0.3 μm and 3.0 μm and an average thickness of less than 0.30 μm accounting for at least 50% of the total projective surface area of said grains.

4. Emulsion according to claim 1, wherein said silver halide is silver bromide or silver bromoiodide.

5. Emulsion according to claim 1, wherein said silver halide grains are sensitive to irradiation in the wavelength range between 540 and 555 nm by the presence of a J-aggregating spectrally sensitizing cyanine dye.

6. Emulsion according to claim 1, having one or more azacyanine dye(s) and J-aggregating spectrally sensitizing dye(s) in a ratio amount of more than 1:4 for a grain coverage exceeding 50%.

7. Light-sensitive silver halide photographic film material comprising a support and on one or both sides thereof at least one light-sensitive layer having an emulsion according to claim 1.

8. Radiographic screen/film combination comprising a light-sensitive silver halide photographic film material according to claim 7 and a supporting or self-supporting X-ray intensifying screen, characterized in that said supported or self-supporting X-ray intensifying screen essentially consists of luminescent phosphor particles emitting green light.

9. Radiographic screen/film combination according to claim 8, wherein said luminescent phosphor is $Gd_2O_2S$:Tb.

10. Radiographic screen/film combination according to claim 8, wherein a total amount of coated silver halide in said film, expressed as an equivalent amount of silver nitrate, is less than 7.5 $g/m^2$.

* * * * *